United States Patent [19]

Cohen et al.

[11] Patent Number: 5,003,674

[45] Date of Patent: Apr. 2, 1991

[54] NEEDLE FELTED FABRICS

[76] Inventors: Samuel Cohen, 146 W. 57th St., New York, N.Y. 10019; Liora G. Manne, 18 E. 18th St., New York, N.Y. 10003

[21] Appl. No.: 388,441

[22] Filed: Aug. 2, 1989

[51] Int. Cl.[5] ..... D04H 1/20

[52] U.S. Cl. ..... 28/109

[58] Field of Search ..... 28/109

[56] References Cited

U.S. PATENT DOCUMENTS

| | | | |
|---|---|---|---|
| 3,794,553 | 2/1974 | Lochner | 28/109 X |
| 4,211,593 | 7/1980 | Lochner | 28/109 X |
| 4,916,782 | 4/1990 | Caldwell | 28/109 X |

FOREIGN PATENT DOCUMENTS

| | | | |
|---|---|---|---|
| 64743 | 10/1982 | Israel . | |
| 7003309 | 2/1970 | Japan | 28/109 |
| 4914424 | 4/1974 | Japan | 28/109 |

*Primary Examiner*—Werner H. Schroeder
*Assistant Examiner*—Bradley Kurtz DeSandre
*Attorney, Agent, or Firm*—Francis J. Bouda

[57] ABSTRACT

In the present invention, a desired pattern or design, is projected upon a relatively flat or horizontal base fabric. The design, which is projected, may be manually or computer-produced, and will indicate a plurality of areas to be covered. Both the shape of the areas and the colors of the areas may also be generated by the projector. Tufts of fibers or swatches of material corresponding to the colors and shapes generated are then placed upon the base material and lightly "tacked" thereto by pre-needling. Thereafter, the base material with the colored fibers or swatches temporarily secured thereto is passed through a commercial high-speed, high-density needling machine which securely and permanently interlocks the fibers or swaches to the base sheet while simultaneously blending the materials and the colors thereof where any of the fibers or swatches of different colors overlap. The soft, muted blending of the colors has not heretofore been achievable by applique, jig-saw type assembly, or the like. The finished product may be thereafter displayed as work of art, or be cut into appropriate shapes for assembly into wearing apparel such as coats, jackets, skirts, and the like. The material may also be used as wall coverings or hangings or pictures.

11 Claims, 2 Drawing Sheets

NEEDLE FELTED FABRICS

BACKGROUND OF THE INVENTION

The present invention relates particularly to high quality fabric material made by a needle felting process and, more specifically, to webs of fabric of artistic design produced by such needle-felting process.

Fundamental needle-felting procedures are well-known in the art and are illustrated by U.S. Pat. Nos. 3,022,873 (Glover); 1,211,821 (Carlson); and 3,822,173 (Graber).

Machines utilizing felting needles to produce webs of material are also well-known and can either be relatively slow speed and basic, such as "tacking" machines illustrated in U.S. Pat. Nos. 3,810,284 (Brochetti) and 3,813,741 (Brochetti), but also may be high-speed, technically sophisticated machines such as Dilo OUG-II and Fehrer NL 2000 as illustrated in U.S. Pat. Nos. 4,651,393 (Dilo); 4,701,986 (Fehrer); and 4,536,927 (Fehrer).

The felting needles themselves are a well-known product and may be as distinct as those used for decades in the preparation of shoddy or hemp or similar coarse material as illustrated in E. P. Foster's U.S. Pat. Nos. 2,322,573; 2,391,560 and 2,495,926, to the more sophisticated state-of-art felting needles as shown in his U.S. Pat. Nos. 4,156,305; 4,037,297 and 4,309,800.

The use of the felting needle process and equipment and materials to produce commercial products such as wall coverings is also well-known.

However, the apparatus, tools and processes used in the felting industry generally produce coarse, heavy industrial or institutional materials such as papermachine felts, wall coverings for offices, floor coverings, carpet backing, geotextiles, and the like, and the very nature and construction of these devices generally militate against the production of fine, soft, high-quality garment material.

One exception is the process disclosed and claimed in Israeli Patent 64743 (published Oct. 31, 1985), which discloses a method for producing applique-type fabric surfaces. That disclosure, however, is more akin to a combination of a jig-saw puzzle and a felting process, or to the assembly of a stained-glass window, or to by "painting-by-numbers", where individual pieces are carefully cut and shaped and are in alignment with each other prior to being interlocked with a fairly heavy base material.

SUMMARY OF THE INVENTION

With the foregoing in mind, it is an object of the present invention to produce an improved quality, artistically designed web of fabric which utilizes at least some of the features of the prior art teachings, but which is so superior to the products of the prior art as to justify its classification as fashion material or works of art.

A further object of the present invention is to prepare one-of-a-kind felted fabric material having made-to-order characteristics, or which can reproduce designs created by internationally famous artists.

Still another object of the present invention is to produce a design using fibers or fabric pieces by needle-felting the materials together so that the colors blend together where dissimilar colors overlap, and requiring no other retaining mechanism.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
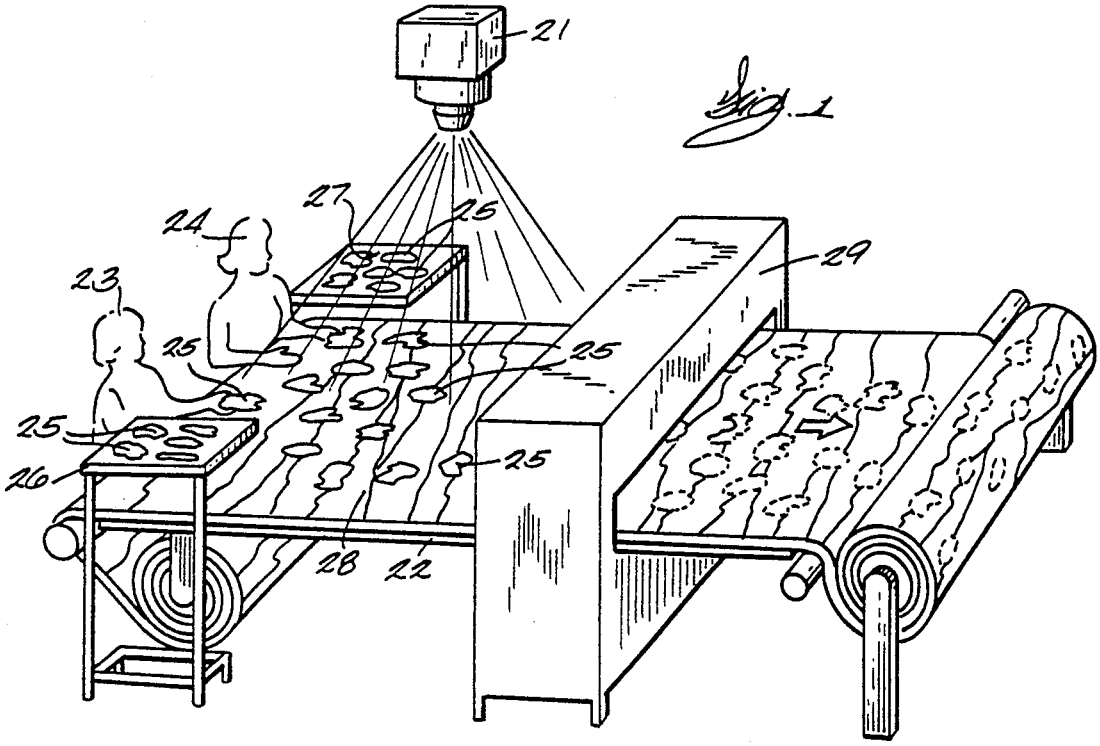
FIG. 1 is a perspective view of one form of apparatus or assembly device using the process of, and to prepare the felted material of, the present invention.
Figure 2:
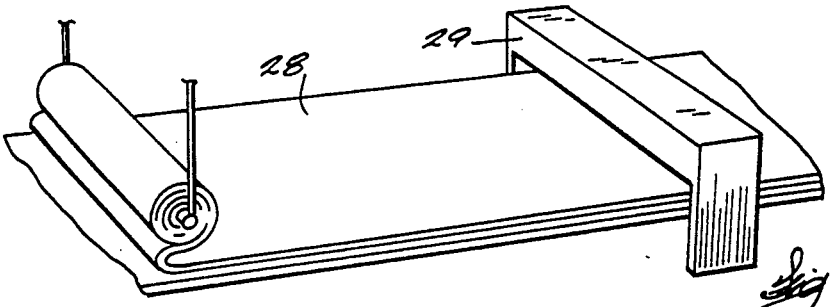
FIG. 2 is a detail of the portion of FIG. 1 showing a form of pre-needling operation.

Referring now to FIG. 1, there is shown a projector 21 which projects onto the work table 22 a picture of the design to be reproduced by the process of the present invention.

One or more workers, 23 and 24, take swatches of material or tufts of fiber 25 from supply-tables 26 and 27 and place them on top of a base material 28 in the arrangement and colors of the picture projected from the slide projector 21.

The swatches of fabric and the tufts of fibers preferably overlap one another so that when the needling process hereinafter described takes place, the various colors of the overlapping materials blend together to form still other colors which are muted and which blend into each other according to the projected design.

In this respect, the system is similar to that of an artist, working with paints or watercolors, who can take the various basic colors and mix them together to form a muted or blended color.

Thus, the process can produce a work of art, the product of which is quite similar to the work product of a painter working in a different medium.

Figure 3:
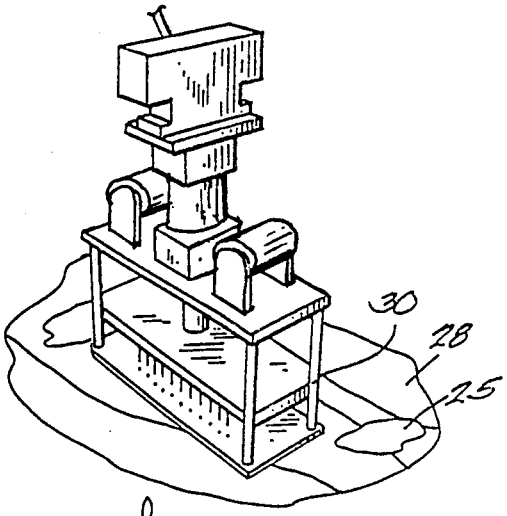
FIG. 3 is a perspective view of another form of pre-needling apparatus.
Figure 4:
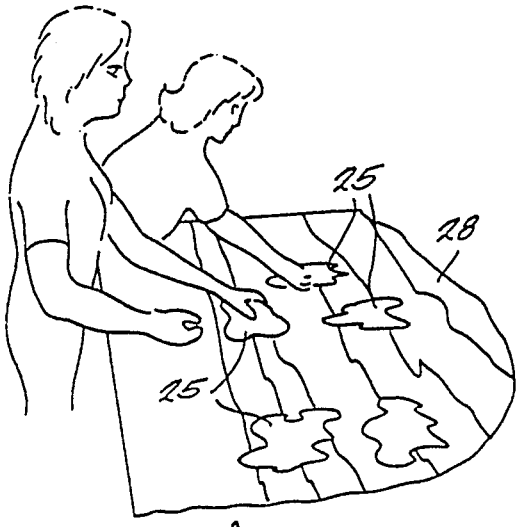
FIG. 4 is a perspective view illustrating how tufts of fibers or swatches of fabric may be arranged on the base material.
Figure 5:
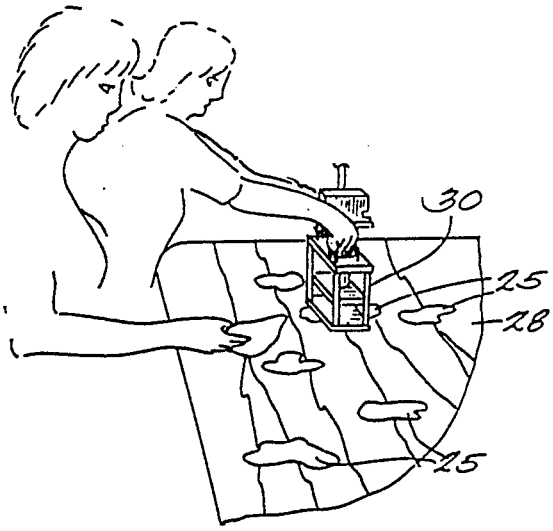
FIG. 5 is an illustration similar to FIG. 3 showing how the alternative pre-needling or "tacking" machine initially fastens the fibers and swatches of material to the base sheet.

After the appropriate fibers or color swatches are placed upon base fabric 28, they are temporarily needled or "tacked" to the base sheet by a pre-needling machine similar to that shown at 29 in FIG. 1, or like the hand-held device shown at 30 in FIG. 3. This "tacking" or temporary needling operation provisionally holds the fibers or swatches of material in place so that the base fabric may be rolled up in whatever length or size desired. It is then transferred to a commercial felting or needling machine which securely fastens the fiber tufts or swatches in place, interlocks and interweaves the fabrics by the mechanical needling process, to provide the blended or muted colors which have heretofore not been possible.

Figure 7:
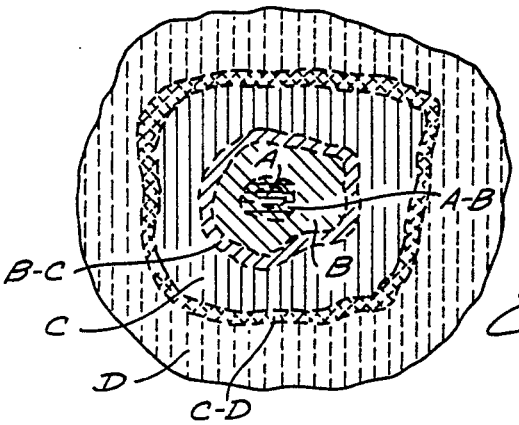
FIG. 7 is an illustration of a design which can be produced on the base sheet by overlapping tufts of fibers or swatches of fabric of purecolors to produce muted or blended color-patterns where the pure colors overlap.

In FIG. 7 we have shown schematically how the muted and blended colors look after the needling process. One pure color D is surrounded by another pure color C, and the area C-D is a blend of the two. Thus, if D is yellow and C is red, then C-D will be orange. Similarly, pure color B surrounds pure color C and the interface of the two at B-C is a blend of those two. The same applies to the area A-B which is a blend of the two pure colors A and B.

Obviously, other pure color fibers may be added to the interface areas so that the colors in those regions may be a blend of three or more colors, as desired or required to provide the subtle tones and shades needed to produce the artistic designs.

Figure 6:
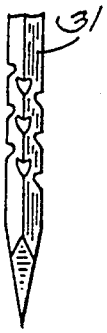
FIG. 6 is an illustration of a high quality, fine gauge felting needle having high density barbs.

In the needling operation, a particularly effective needle is the Foster Needle Company HDB (high density barb) needle 31 shown in FIG. 6. In the HDB needle, the barbs are spaced at approximately 0.051"–0.052" (1.3 millimeters) apart on each apex of a triangular or pinch blade. As such barbs are approximately 60% closer together than the next standard barb spacing which is a Close Barb with spacing of 0.125" (3.2 millimeters) barb separation, a finer and more attractive pattern is produced because of the absence of the needle holes in the finished product.

These Foster HDB needles, not found on other needle blades, offer the following advantages:

1. Increased fabric integrity and higher tensile strength.
2. Reduced fiber/filament damage.
3. Smoother fabric surfaces.
4. Ability to use much lower penetration depth.

When the assembled base fabric with the cut pieces or swatches temporarily tacked thereto have been passed through heavy-duty or commercial needle felting machines, the blended array that is created is unique because of its complete difference in character from "structured" wall-coverings heretofore available in needled felt coverings for industrial or commercial installations.

Such structured wall coverings of the prior art are described in Dilo U.S. Pat. No. 4,651,393 and have been produced in the past by the Ozite Company of Illinois. In such structured wall coverings, the patterns are regular and coarse and commercial and processes of the past have not been able to produce the individual, blended and muted colors and high quality garment fabric or artworks produced by the present invention.

Similarly, the process of the present invention is completely different from the method of making stained glass windows or "painting by the numbers", or jig-saw puzzles, because the process of the present invention permits the blending and muting of the colors not possible by any of the prior art procedures.

A more detailed and complete description of the process leads to a better understanding of the improvement of the present invention over prior practices.

In the first instance, a base sheet or webbing material, which may be a felted fabric or a nonwoven material, or a woven base sheet secured from any one of a number of sub-contractors. This material may include dyed fibers of a variety of materials, such as acrylic, silk, wool, cotton, polyester, or the like. Dyed fibers of pure colors may be used individually, or may be processed through a needling or weaving loom into webbings which may be a single color or may be a combination of colors.

Thereafter, the pure color webbings, or mixed color webbings are cut into appropriate shapes, either by a computerized water-jet cutter, a computerized fabric cutter, a mechanical fabric cutter, or by hand, into such shapes as may be used in the desired pattern of the end product.

Next the tufts of fiber or yarns, or the different shapes of webbing or other materials such as scrim, chiffon, lace material or the like are laid upon a base sheet which has the design projected thereupon by a slide projector, and according to the image that is projected, which may include indications of color as well as shape.

Subsequently, the base sheet with the swatches of colored webbing material or tufts of fibers are pre-needled or "pre-tacked", either by a portable needling machine or by a cylinder pre-needle device, so as to be provisionally attached to the base by the temporary needling process.

All of the foregoing steps or processes can be accomplished in the studio of the artists.

After the base sheet with its provisionally attached fibers and swatches thereon is rolled up and taken to a subcontractor, where it is put through a heavy-duty needling loom where all of the pre-needled materials are permanently attached to the final fabrics, and where the high-density barbs and the rapidity of the needle-punching process blends the fibers together to the precise color desired by the artist and as projected by the slide projector onto the base sheet.

Finally the permanently-needled products may be given a calendering or brushing procedure to enhance the texture or surface characteristic of the finished material.

Moreover, the final needling operation is a "high density" procedure which, when coupled with the use of the "high density" barb, fine-gauge needles, the multi-colored layout of the fibers and the individual design of the artists, produces a fabric which has heretofore not been available or known.

More importantly, the process of the present invention is distinguished from the prior art disclosures and particularly the method for producing applique-type fabric surfaces as disclosed in Israeli Patent 64743 of Oct. 1, 1982, in its completely new possibility for providing a blended and muted-color pattern combinations of the present invention when working with the "high density" barb needles described hereinabove.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

We claim:

1. The process for producing improved needle-felted fabrics including, providing a web of base fabric (28), arranging colored fibers (25) on appropriate and corresponding places on a base fabric (28), at least some fibers (A, B, C, D,) of one color overlapping some fibers A, B, C, D of another color, so that the colors will blend in the overlapped areas (A-B, B-C, C-D), lightly securing the various-colored fibers (25) onto the base fabric (28) by pre-needling (29) with felting needles, permanently securing the pre-needled (29) base fabric and colored fibers (25) by subsequent needling with fine gauge felting needles (31).

2. The process of claim 1 which includes preparing a design on the web of base fabric to guide the placement of the colored fibers thereon.

3. The process of claim 1 wherein the design is the projection (21) of a slide picture.

4. The process of claim 3 wherein the design projected is that of a work of art.

5. The process of claim 4 which includes forming the colored fibers (25) into carded webs and cutting the colored webs to correspond to the desired shapes on the base fabric (28).

6. The process of claim 1 which includes finish-treating the needled assembly of base fabric and colored webs.

7. The process of claim 6 wherein the finish treatment is a calendering operation.

8. The processing of claim 6 wherein the finish treatment is a brushing operation.

9. The process of claim 3 wherein the colored webs are cut to appropriate shapes by a computerized cutter.

10. The process of claim 9 wherein the computerized cutter is a water-jet cutter.

11. An improved needle-felted fabric prepared by the process of claim 1.

* * * * *